US007936307B2

(12) United States Patent
Pang et al.

(10) Patent No.: US 7,936,307 B2
(45) Date of Patent: May 3, 2011

(54) COVER ANTENNAS

(75) Inventors: Hawk Yin Pang, Tokyo (JP); Jani Ollikainen, Helsinki (FI); Marko Leinonen, Haukipudas (FI)

(73) Assignee: Nokia Corporation, Espoo (FI)

( * ) Notice: Subject to any disclaimer, the term of this patent is extended or adjusted under 35 U.S.C. 154(b) by 196 days.

(21) Appl. No.: 11/492,677

(22) Filed: Jul. 24, 2006

(65) Prior Publication Data

US 2008/0018541 A1 Jan. 24, 2008

(51) Int. Cl.
*H01Q 1/24* (2006.01)

(52) U.S. Cl. ..... 343/702; 343/700 MS; 343/846

(58) Field of Classification Search ..... 343/700 MS, 343/702, 713, 850, 853, 860, 767, 790, 858, 343/859, 846, 770; 455/575.7
See application file for complete search history.

(56) References Cited

U.S. PATENT DOCUMENTS

| | | | | |
|---|---|---|---|---|
| 5,483,678 | A * | 1/1996 | Abe | 455/80 |
| 5,767,810 | A * | 6/1998 | Hagiwara et al. | 343/700 MS |
| 5,969,681 | A * | 10/1999 | O'Neill, Jr. | 343/700 MS |
| 6,014,113 | A * | 1/2000 | Orchard et al. | 343/841 |
| 6,229,495 | B1 | 5/2001 | Lopez et al. | |
| 6,483,463 | B2 * | 11/2002 | Kadambi et al. | 343/700 MS |
| 6,624,788 | B2 * | 9/2003 | Boyle | 343/702 |
| 6,753,815 | B2 * | 6/2004 | Okubora et al. | 343/700 MS |
| 6,759,991 | B2 * | 7/2004 | Boyle | 343/702 |
| 6,937,205 | B2 * | 8/2005 | Chou et al. | 343/841 |
| 7,043,285 | B2 * | 5/2006 | Boyle | 455/575.7 |
| 7,443,344 | B2 * | 10/2008 | Boyle | 343/700 MS |
| 7,443,810 | B2 * | 10/2008 | Boyle | 370/281 |
| 7,463,197 | B2 * | 12/2008 | Rafi et al. | 343/700 MS |
| 7,469,131 | B2 * | 12/2008 | Nail et al. | 455/168.1 |
| 2004/0147297 | A1 | 7/2004 | Mikkola et al. | |

FOREIGN PATENT DOCUMENTS

| | | |
|---|---|---|
| GB | 2364176 | 1/2002 |
| JP | 2004040554 | 2/2004 |

* cited by examiner

*Primary Examiner* — Douglas W Owens
*Assistant Examiner* — Chuc D Tran

(57) ABSTRACT

The specification and drawings present a new apparatus, method and software product for using a cover antenna (e.g., conductive, metallic, etc.) in an electronic device, with multiple coupled feeds (e.g., dual feed) to the antenna and with one or more switches and a matching circuit. Then it is possible to use a metal plate as a metal cover, e.g., for mobile devices, which will act as an antenna with multiple feedings for cellular and non-cellular radios.

29 Claims, 5 Drawing Sheets

COVER ANTENNAS

FIELD OF THE INVENTION

This invention generally relates to wireless communications and more specifically to using conductive cover antennas in electronic devices.

BACKGROUND ART

There is a strong demand for mobile devices to have metal covers whether the device is partly or completely encapsulated in a metal. This is because of the feel, looks, and "coldness" of the mobile device when covered with the metal. The majority of today's mobile phones use look alike metallic paint which still does not measure up to a real metal. However, there are few products with metal covers, e.g., NOKIA 8800. Part of the phone does not use metal, but instead a plastic is used. The reason for this is that the antenna which is located in this region can radiate without severe degradation of performance only if this antenna is separated by the plastic from the metal part.

DISCLOSURE OF THE INVENTION

According to a first aspect of the invention, an apparatus, comprises: an antenna wherein the antenna is at least a part of a cover of the apparatus; and a plurality of coupled feeds to the antenna, configured for reception or transmission of a further plurality of electromagnetic signals at different frequencies, each electromagnetic signal having a unique frequency, wherein each of the coupled feeds is optimized for at least one frequency selected from the different frequencies.

According further to the first aspect of the invention, the apparatus may further comprise a matching circuit for the antenna. Further, the matching circuit may comprise a plurality of matching circuits and each coupled feed of the plurality of the coupled feeds may comprise one corresponding circuit of the plurality of the matching circuits.

According further to the first aspect of the invention, each of the electromagnetic signals may have a corresponding electrical signal of a corresponding further plurality of electrical signals, the corresponding electrical signal propagating only in one of the coupled feeds, the apparatus may further comprise: at least one switch, for switching the electrical signals so that at least one of the electrical signals is passed without being substantially attenuated and at least one another of the electrical signals is substantially attenuated with respect to the at least one of the electrical signals after it is passed. Further, the at least one of the electrical signals may be only one electrical signal passed without being substantially attenuated. Further still, the at least one switch may comprise one of: a) one switch configured to attenuate the at least one another of the electrical signals to substantially zero and to pass the at least one of the electrical signals without being substantially attenuated, and b) a corresponding plurality of switches, one for each of the coupled feeds, each configured to pass or attenuate one or more electrical signals propagating through the each of the coupled feeds. Yet still further, the apparatus may further comprise: a corresponding plurality of band pass filters, at least one band pass filter for each of the coupled feeds, wherein the apparatus may be configured to select the at least one band pass filter for each of the coupled feeds and wherein each of the band pass filters may be configured to pass at least one further electrical signal of the at least one of the electrical signals by tuning the pass band, wherein the at least one further electrical signal is selected from the at least one of the electrical signals. Yet still further still, the at least one further electrical signal may be only one electrical signal passed without being substantially attenuated.

Still further according to the first aspect of the invention, the apparatus may further comprise one of: a) a corresponding transmission channel matched to one or more of the different frequencies, and b) a corresponding transmission channel implemented as a microwave transmission line and matched to one or more of the different frequencies, wherein each of the coupled feeds is coupled to the corresponding transmission channel.

According further to the first aspect of the invention, a number of the coupled feeds may be two.

According still further to the first aspect of the invention, a number of the coupled feeds may be equal or smaller than a number of the different frequencies. According further still to the first aspect of the invention, at least one of the electromagnetic signals may have a first frequency, and a first corresponding coupled feed of the coupled feeds may be configured to support one of: a) a wireless local area network communication, b) a BLUETOOTH communication, and c) WiMAX wireless metropolitan access network communication, d) and wherein at least one another of the electromagnetic signals may have a second frequency, and a second corresponding coupled feed of the coupled feeds may be configured to support one of: a) a global positioning system communication, and b) a digital video broadcasting-handset communication.

According yet further still to the first aspect of the invention, the electromagnetic signals may be radio signals.

Yet still further according to the first aspect of the invention, the antenna may completely comprise the cover.

Still yet further according to the first aspect of the invention, the antenna may be conductive throughout.

According to a second aspect of the invention, a method, comprises: receiving or transmitting, by an antenna with a matching circuit and with a plurality of coupled feeds, a further plurality of electromagnetic signals at different frequencies, each electromagnetic signal having a different frequency, wherein each of the coupled feeds is optimized for at least one frequency selected from the different frequencies, and wherein the antenna is a part of a cover of an electronic device.

According further to the second aspect of the invention, each of the electromagnetic signals may have a corresponding electrical signal of a corresponding further plurality of electrical signals, the corresponding electrical signal propagating only in one of the coupled feeds, the method may further comprise: switching the electrical signals so that at least one of the electrical signals is passed without being substantially attenuated and at least one another of the electrical signals is substantially attenuated with respect to the at least one of the electrical signals after it is passed. Further, the at least one of the electrical signals may be only one electrical signal passed without being substantially attenuated.

Further according to the second aspect of the invention, each of the coupled feeds may be coupled to one of: a) a corresponding transmission channel matched to one or more of the different frequencies, and b) a corresponding transmission channel implemented as a microwave transmission line and matched to one or more of the different frequencies.

Still further according to the second aspect of the invention, a number of the coupled feeds may be two.

According further to the second aspect of the invention, a number of the coupled feeds may be equal or smaller than a number of the different frequencies.

According still further to the second aspect of the invention, the electromagnetic signals may be radio signals.

According further still to the second aspect of the invention, the antenna may completely comprise the cover.

According to a third aspect of the invention, a computer program product comprises: a computer readable storage structure embodying computer program code thereon for execution by a computer processor with the computer program code, wherein the computer program code comprises instructions for performing the method of the second aspect of the invention.

According to a fourth aspect of the invention, an apparatus, comprises: means for receiving or transmitting, made of a conductive material, the means for receiving or transmitting is a part of a cover of the apparatus; and a plurality of means for feeding to the means for receiving or transmitting, configured for reception or transmission of a further plurality of electromagnetic signals at different frequencies, each electromagnetic signal having a unique frequency, wherein each of the means for feeding is optimized for at least one frequency selected from the different frequencies.

According further to the fourth aspect of the invention, the apparatus may further comprise a matching circuit for the means for receiving or transmitting. Further, the matching circuit may comprise the plurality of matching circuits and each coupled feed of the plurality of the coupled feeds may comprise one corresponding circuit of the plurality of the matching circuits.

Still further according to the fourth aspect of the invention, each of the electromagnetic signals may have a corresponding electrical signal of a corresponding further plurality of electrical signals, the corresponding electrical signal propagating only in one of the coupled feeds, the apparatus may further comprise: at least one means for switching the electrical signals so that at least one of the electrical signals is passed without being substantially attenuated and at least one another of the electrical signals is substantially attenuated to zero.

According further to the fourth aspect of the invention, the means for receiving may be an antenna.

BRIEF DESCRIPTION OF THE DRAWINGS

For a better understanding of the nature and objects of the present invention, reference is made to the following detailed description taken in conjunction with the following drawings, in which.

MODES FOR CARRYING OUT THE INVENTION

Figure 1:
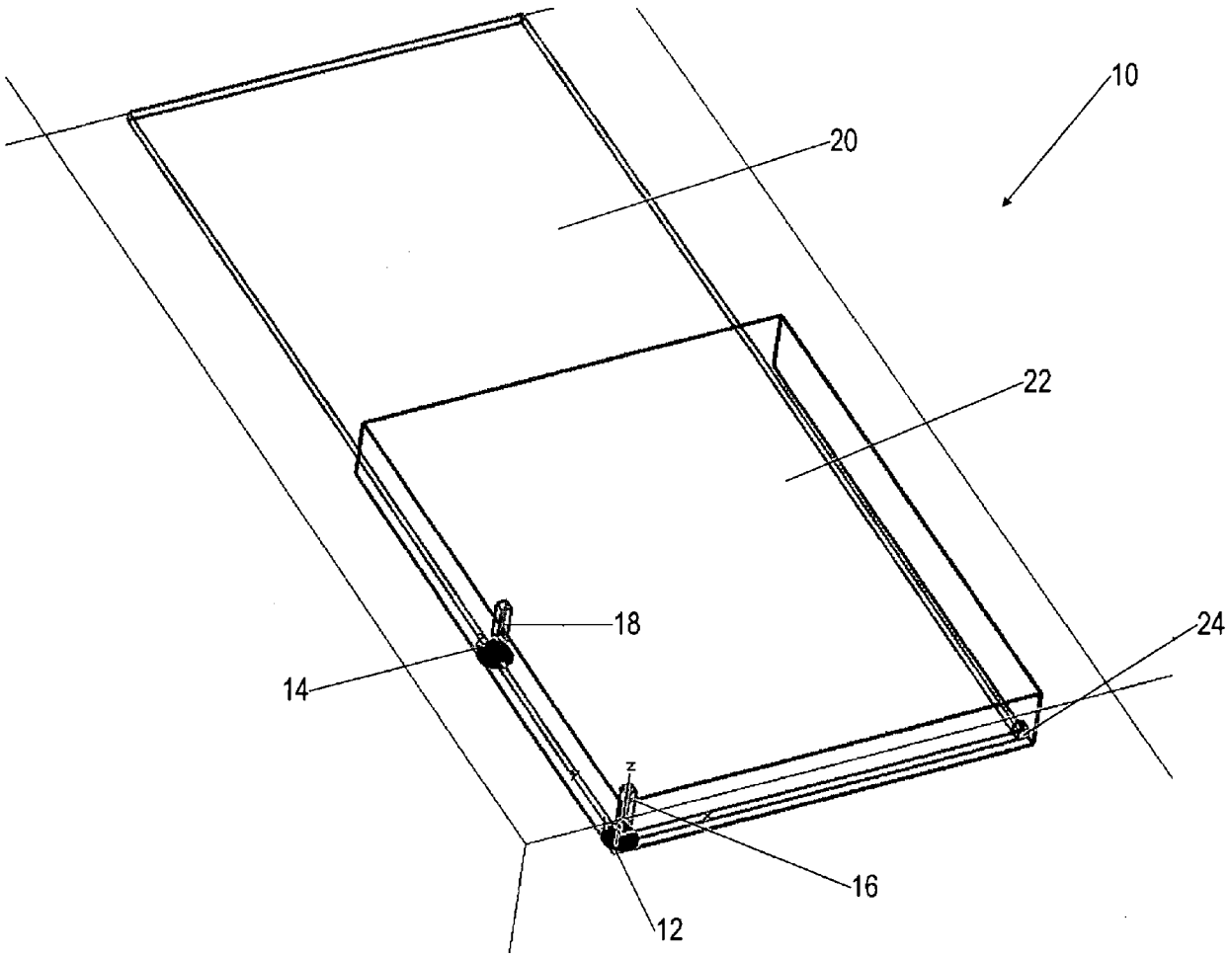
FIG. 1 is a schematic representation of a conductive (e.g., metallic) cover antenna with a dual feed, according to an embodiment of the present invention.

A new apparatus, method and software product are presented for using a cover antenna (e.g., conductive, metallic, etc.) in an apparatus (e.g., a an electronic device, a communication device, a wireless communication device, a portable electronic device, a non-portable electronic device, a mobile electronic device, a mobile phone, a wireless access point, a base station, etc.) with multiple coupled feeds (e.g., using a dual feed) to the antenna and with one or more switches and a matching circuit. Then it is possible to use a metal plate as a metal cover, e.g., for mobile devices, which will act as an antenna with multiple feedings for cellular and non-cellular radios. Since space/volume is limited in the mobile devices, reuse of the metal cover as antenna can be advantageous.

According to an embodiment of the present invention, the apparatus can comprise a conductive (e.g., metallic) antenna with a matching circuit, and M coupled feeds for said antenna, wherein the antenna may comprise a whole cover or be a part of the cover of an electronic device. Furthermore, the antenna may be conductive throughout or may comprise a conductive portion and a dielectric portion.

The antenna can convert N electromagnetic signals (e.g., radio signals) received by the antenna, each having a unique (i.e., operating) frequency out of N frequencies (or frequency bands), into corresponding N electrical (e.g., microwave) signals such that each of the M coupled feeds with a corresponding transmission channel (e.g., a microwave transmission line having a matching length, LC matched or others) is optimized for propagating only at least one of the N electrical signals, i.e., it is optimized only for at least one frequency corresponding to the at least one electrical signal and selected from the N frequencies, wherein M and N are integers each having at least a value of two (i.e., the antenna having at least two coupled feeds), and wherein $N \geqq M$.

Furthermore, according to an embodiment of the present invention, one coupled feed can support more than one frequency out of frequencies supported by that coupled feed, such that a signal with the desired frequency is further selected by further filtering, e.g., using a tunable filter. In this case, $N>M$.

For example, antenna resonances in a mobile terminal can cover four GSM (global system for mobile communications) bands (GSM850, GSM900, GSM1800, GSM1900) or any combination of these GSM bands using, e.g., two antenna resonances, one resonance for GSM850 and/or GSM900 bands and another resonance for GSM1800 and/or GSM1900 bands, and using one coupled feed. Each band can be selected then in said one coupled feed using a tunable or selectable filter as demonstrated in detail in FIG. 3*b*. Moreover, each of the frequency bands may be used for cellular and non cellular operations, e.g., for BLUETOOTH (BT) and GSM.

According to a further embodiment of the present invention, the N electrical signals can be switched using at least one switch such that at least one of the N electrical signals is substantially attenuated to zero (e.g., using an infinite impedance) but at least one another of the N electrical signals is passed without being substantially attenuated. The at least one switch can be implemented as: a) one switch configured to attenuate one or more of the N electrical signals to zero and to pass one or more of the N electrical signals without being substantially attenuated, and b) M switches, one for each of the M coupled feeds (or transmission channels), each configured to pass or attenuate one or more electrical signals of the N electrical signals for choosing the signal in a desired channel.

According to an embodiment of the present invention a switch is connected to each of M coupled feeds and selects if this coupled feed will be connected to the next stage. The next stage after the switch at each coupled feed can be a matching circuit that transforms the feed impedance over at least one desired frequency (or frequency band) band so that it is suitable for the following stage (typically to 50 ohms). The next stage can be a filter (typically a band pass filter) as discussed below. It is noted that it may be advantageous to use a matching circuit also between each feed and the switch to control the impedance level of the switch and hence the power loss in the switch as well as the distortion generated by it. Typically, each of the coupled feeds is matched to a frequency band that is substantially different from the others but in principle the coupled feeds can be matched to the same frequency band or overlapping frequency bands as well. According to an embodiment of the present invention, at least one of the M coupled feeds, optimized for at least one operational (unique) frequency, can be configured to support a wireless local area network (WLAN) communication, a BLUETOOTH (BT) communication, a wireless metropolitan access network (WiMAX) communication, etc., whereas at least one another of the M coupled feeds, optimized for another at least one operational frequency, can be configured to support a global positioning system (GPS) communication, a digital video broadcasting-handset (DVB-H) communication, etc.

Moreover, M band pass filters (e.g., Chebyshev filters) with fixed or tunable component values, one for each of the M coupled feeds, can be used for passing substantially at least one of the N electrical signals with the unique frequency or frequencies out of the N frequencies. Thus, each of these M band pass filters can select an electrical signal with at least one frequency out of the electrical signals propagating through the corresponding coupled feed by tuning its pass band. Also, it is noted that using a band pass filter can minimize frequency selectivity requirements for the matching circuits. There may be multiple band pass filters which are selected based on the received/transmitted signal frequency. The band pass filter which is discussed here can be used as a pre-selection filter of the radio transceiver. The pre-selection filter provides an attenuation of the unwanted blocking signal outside of the reception band and attenuation for the unwanted transmissions outside of the operational transmission band.

Figure 3A:
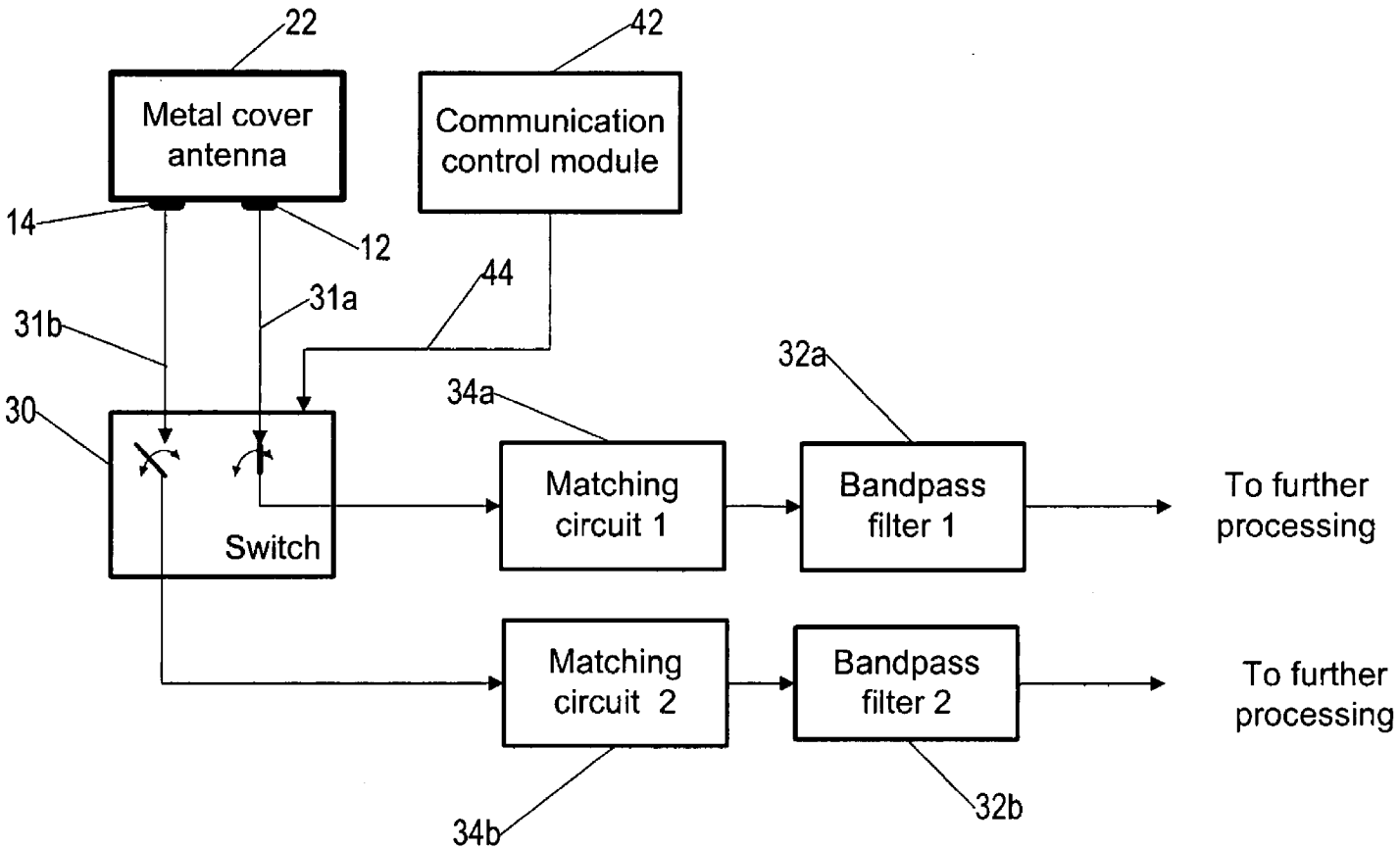
FIGS. 3*a* and 3*b* are block diagrams of an electronic device comprising a conductive (e.g., metallic) cover antenna with two coupled feeds with one switch, according to an embodiment of the present invention.
Figure 3B:
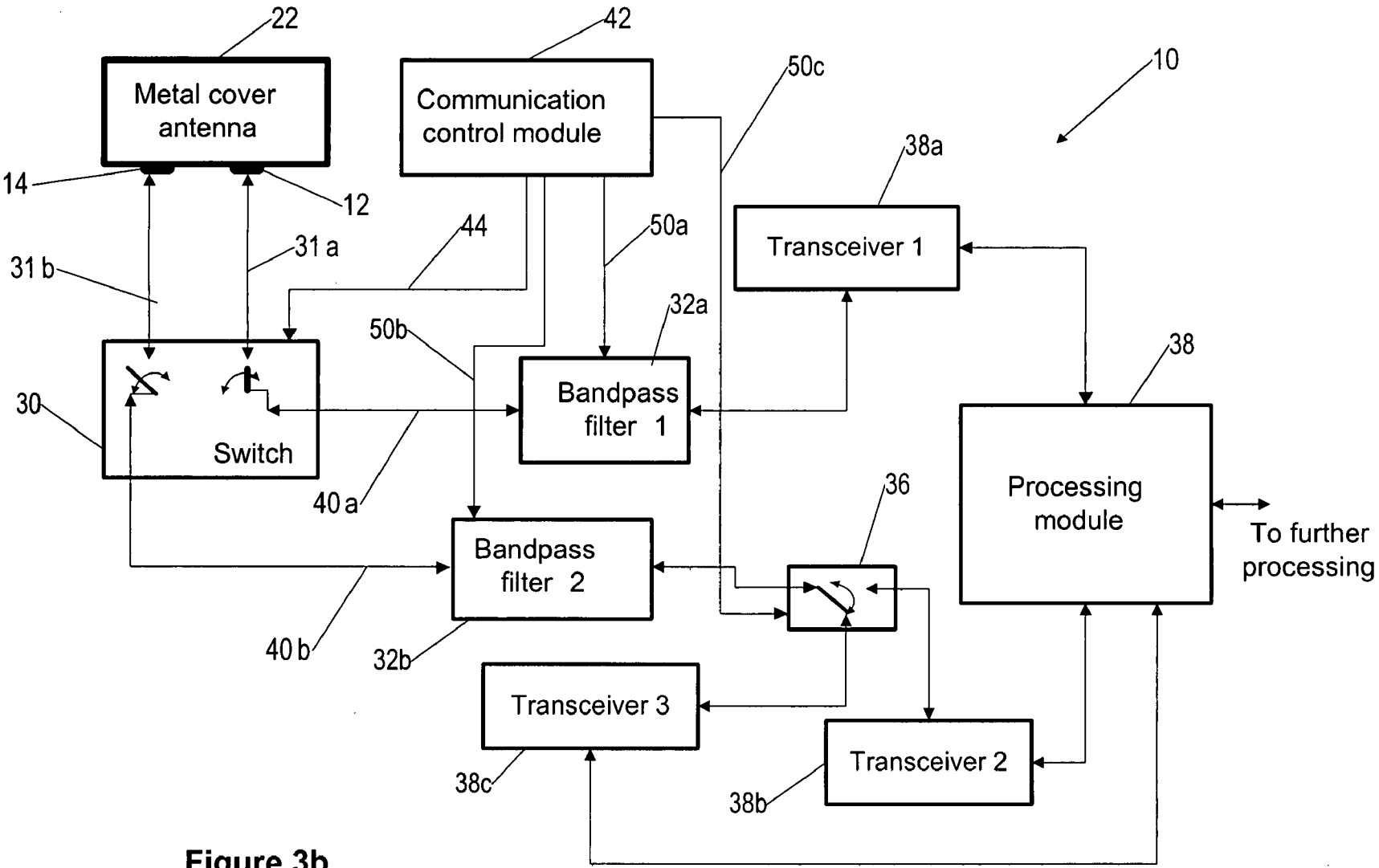

The embodiments described above can be applied to receiving and/or transmitting the electromagnetic signals as further demonstrated in detail in FIG. 3*b*. Also, it is noted that various embodiments of the present invention recited herein can be used separately, combined or selectively combined for specific applications.

FIG. 1 shows an example among others of a schematic representation of cover antenna 22 (e.g., using metal cover) with a dual feed with coupled feeds 12 and 14 in an electronic device 10, according to an embodiment of the present invention. The coupled feeds 12 and 14 are connected to the antenna 22 with conducting pins 16 and 18, respectively. In this example, the metal antenna 22 with dimensions, e.g., 51 mm×42 mm is a cover of the electronic device 10.

In the example of FIG. 1, the antenna 22 is grounded with a pin 24 to a printing wiring board (PWB) 20. The PWB has dimensions 100 mm×40 mm. The metal antenna 22 can be raised over the PWB 20, e.g., by 5 mm. The coupled feeds 12 and 14 are located at feed points with coordinates at x=0 mm, y=0 mm and x=0 mm, y=25 mm respectively, as shown in FIG. 1, with matching circuit (LC matching circuit optimized for 50 ohm at a center frequency of interest).

It is noted that parameters (e.g., length, width, height over the PWB) of the antenna 22 can be varied and optimized according to a particular design requirements.

Figure 2:
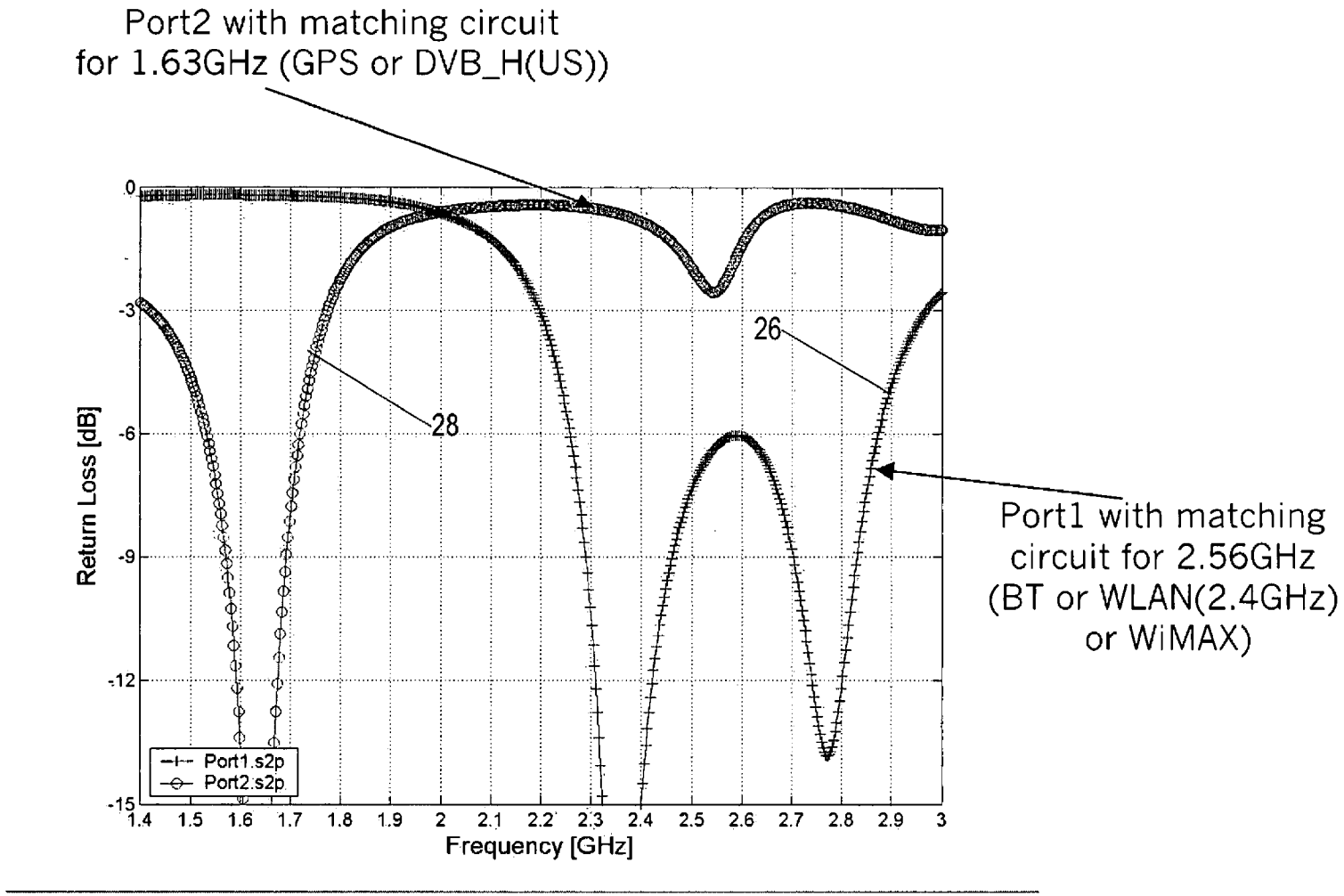
FIG. 2 is a graph of a return loss of two coupled feeds, coupled feed 1 and coupled feed 2 of a conductive (e.g., metallic) cover antenna, as a function of frequency, wherein only one coupled feed is open by switching, according to an embodiment of the present invention.

FIG. 2 demonstrates a simulation example showing a graph (see curves 26 and 28) of a return loss of two coupled feeds, coupled feed 1 and coupled feed 2 (e.g., coupled feeds 12 and 14, respectively, in FIG. 1) of a conductive (e.g., metallic) cover antenna 22, shown in FIG. 1, as a function of frequency, wherein only one coupled feed 12 or 14 is closed by switching (i.e., no substantial attenuation), while the other coupled feed (14 or 12, respectively) is high impedance (i.e., an open circuit), according to an embodiment of the present invention. Here, the coupled feed 1 (e.g., the coupled feed 12), is optimized for maximum frequency bandwidth near 2.5 GHz and can cover BT, WLAN (2.4 GHz) or WiMAX communications, when the coupled feed 2 (e.g., the coupled feed 14) is open circuit by switching, which corresponds to the curve 26 in FIG. 2. The coupled feed 2 (e.g., the coupled feed 14) is optimized for maximum frequency bandwidth centered at 1.63 GHz and can cover GPS or DVB_H (US) communication, whilst coupled feed 1 (e.g., the coupled feed 12) is open circuit by switching, which corresponds to the curve 28 in FIG. 2.

The results shown in FIG. 2 are generated using EM (electromagnetic) CST (computer simulation technology) microwave simulation software with a solver accuracy of −40 dB, global meshing properties lines per wavelength, lower mesh limits, a mesh line ratio limit set to 20. The simulations use the PWB (thickness 1 mm) and the metal cover (thickness 0.1 mm) with ideal conductivity and with a dielectric material between the PWB and the metal cover being air. In addition, the simulation boundary is OPEN, i.e., waves can pass a boundary with minimal reflections. Two coupled feeds each correspond to 50 ohm. The s-parameters from the CST simulation were then exported into Agilent ADS (advanced design system) circuit simulator, where the LC matching components and band pass filtering is simulated together with the s-parameters.

FIG. 3*a* is an example among others of a block diagram of an electronic device 10 comprising the cover antenna 22 (e.g., using metal cover) with two coupled feeds 12 and 14 and with one switch 30, according to an embodiment of the present invention. FIG. 3*a* demonstrates a receiving mode of operation. Two corresponding electrical (microwave) signals 31*a* and 31*b* provided by the antenna 22 through the coupled feeds 12 and 14, respectively, are switched by the switch 30 such that only one of these signals 31*a* or 31*b* can propagate through matching circuits 34*a* and 34*b* for further filtering by band pass filters 32*a* or 32*b*, respectively, and then to further processing. A communication control module 42 can send a command signal 44 to the switch 30 to trigger its switching for receiving the desired signal (31*a* or 31*b*).

FIG. 3*b* is a further example among others of a block diagram of an electronic device 10 comprising the cover antenna 22 (e.g., using the metal cover) with two coupled feeds 12 and 14 and with one switch 30, according to an embodiment of the present invention. FIG. 3*b* demonstrates both receiving and transmitting mode of operation. Two corresponding electrical (microwave) signals 31*a* and 31*b* provided or received by the antenna 22 through the coupled feeds 12 and 14, respectively, are switched by the switch 30 such that only one of these signals 31*a* or 31*b* can propagate further for further filtering by band pass filters 32*a* or 32*b* (receiving mode) or to the antenna 22 (transmitting mode), respectively (the matching circuits are not shown). Then the filtered signal (in the receiving mode) is further passed to the transceiver 38*a*, 38*b* or 38*c* and then to a processing module 38. The transceiver is a functional block which includes a transmitter and/or receiver functionality. The transceiver 38*a*, 38*b* or 38*c* can be also a single receiver without the transmitter functionality or a single transmitter without the receiver functionality. A communication control module 42 can send a command signal 44 to the switch 30 to trigger its switching for receiving the desired signal (31*a* or 31*b*).

The signals 50*a* and 50*b* from the communication control module 42 can be provided to the band pass filters 32*a* and 32*b*, respectively. These signals 50*a* and 50*b* can control the center frequency of the band pass filters in order to optimize the filtering of the received and/or transmitted signals 40*a* and 40*b*. By controlling the band pass filter center frequency or the shape of the band pass filter the transmission and reception signal quality can be optimized. The filter center frequency or the filter shape can be changed by tuning the electrical properties/values of the components of the filters 32*a* and 32*b* as known in the art. Alternatively the signals 50*a* and 50*b* may be used to select from multiple band pass filters an appropriate filter for the operational frequency. The functional block 32*b* may include several physical band filters. For example block 32*b* in FIG. 3*b* may include band pass filters for both transceivers 38*b* and 38*c*, and the operational filter can be selected by the signal 50*b*.

FIG. 3*b* also shows that the transceivers 38*b* and 38*c* can be used with a further switch 36, as shown, for transmitting information through the corresponding channels using their optimized frequencies. Thus, the band pass filter 32*b* can be tuned to transmit two frequencies which are then further selected by the further switch 36 using, e.g., a control signal 50*c* from the module 42.

According to an embodiment of the present invention, the block 30, 36 or 42 can be implemented as a software block, a hardware block or a combination thereof. The blocks 30, 36 and 42 are functional blocks and thus, each of the blocks 30, 36 or 42 can be implemented as a separate block or can be combined with any other standard block of the electronic device 10, or it can be split into several blocks according to their functionality.

Figure 4:
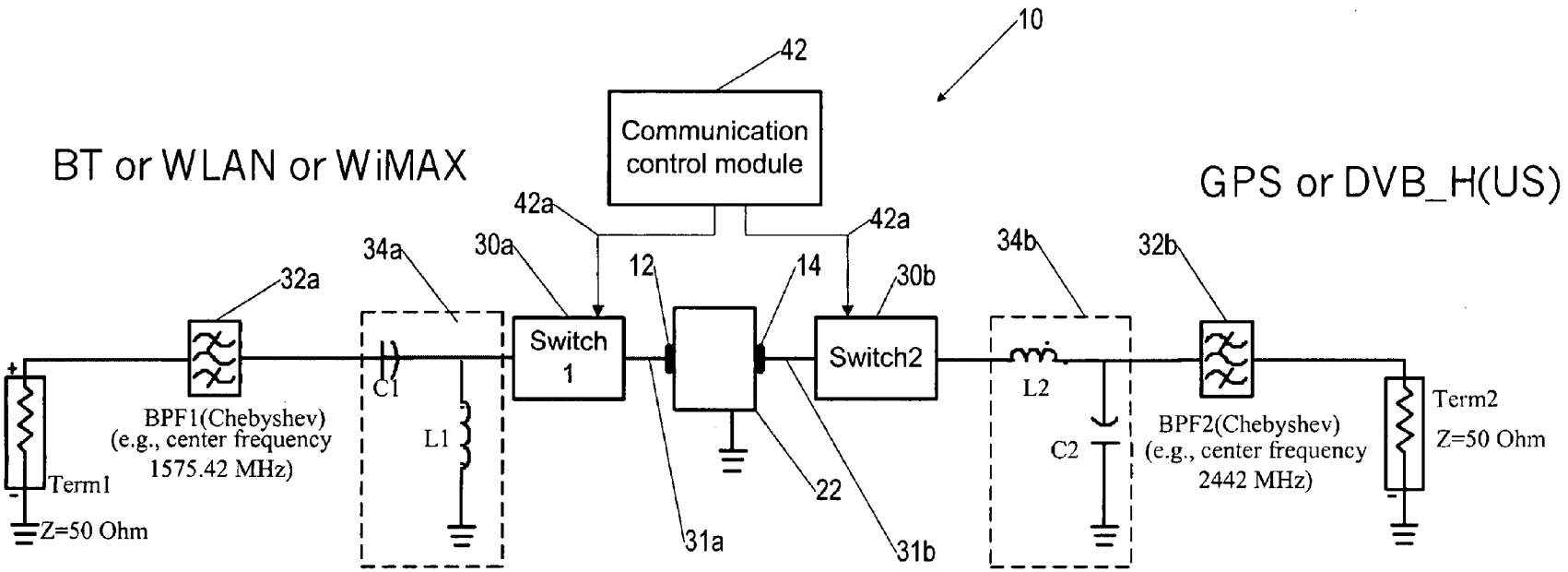
FIG. 4 is a block diagram of an electronic device comprising a conductive (e.g., metallic) cover antenna with two coupled feeds with two switches and corresponding two matching band pass filters, according to an embodiment of the present invention.

FIG. 4 is another example a block diagram of an electronic device 10 comprising the cover antenna 22 (e.g., using the metal cover) with two coupled feeds 12 and 14 and with two switches 30*a* and 30*b* (one switch, as shown in FIGS. 3*a* and 3*b*, can be used instead), two corresponding matching circuits 34*a* and 34*b*, and two corresponding matching band pass filters 32*a* and 32*b*, respectively, according to an embodiment of the present invention. In FIG. 4, the matching circuits 34*a* and 34*b* for two channels each comprising LC circuits. The LC circuits is only one simple example for implementing matching circuits shown in FIG. 4 among many other possible implementations known in the art.

The communication control module 42 can send command signals 44*a* and 44*b* to the switches 30*a* and 30*b*, respectively, to trigger their switching (e.g., signal 44*a* is "on" and signal 44*b* is "off") for the desired signal (31*a* or 31*b*).

As explained above, the invention provides both a method and corresponding equipment consisting of various modules providing the functionality for performing the steps of the method. The modules may be implemented as hardware, or may be implemented as software or firmware for execution by a computer processor. In particular, in the case of firmware or software, the invention can be provided as a computer program product including a computer readable storage structure embodying computer program code (i.e., the software or firmware) thereon for execution by the computer processor.

It is to be understood that the above-described arrangements are only illustrative of the application of the principles of the present invention. Numerous modifications and alternative arrangements may be devised by those skilled in the art without departing from the scope of the present invention, and the appended claims are intended to cover such modifications and arrangements.

What is claimed is:

1. An apparatus, comprising:

a cover antenna wherein said cover antenna forms at least a part of a partly or completely encapsulating metal cover of said apparatus; and a plurality of coupled feeds to said cover antenna, configured to receive and transmit a plurality of electromagnetic signals at different frequencies, each electromagnetic signal having a unique frequency, wherein each of the coupled feeds is optimized for at least one frequency selected from said different frequencies, and wherein a distance between each of said plurality of coupled feeds and a grounding pin of said cover antenna is larger than a distance between said cover antenna and a printed wiring board within said apparatus and connected to said cover antenna via said grounding pin.

2. The apparatus of claim 1, further comprising a matching circuit for said cover antenna.

3. The apparatus of claim 2, wherein said matching circuit comprises a plurality of matching circuits and each coupled feed of the plurality of the coupled feeds comprises one corresponding circuit of the plurality of the matching circuits.

4. The apparatus of claim 1, wherein each of said electromagnetic signals has a corresponding electrical signal of a corresponding further plurality of electrical signals, said corresponding electrical signal propagating only in one of said coupled feeds, said apparatus further comprises:

at least one switch, configured to switch said electrical signals so that at least one of said electrical signals is passed without being substantially attenuated and at least one other of said electrical signals is substantially attenuated with respect to the at least one of said electrical signals after it is passed.

5. The apparatus of claim 4, wherein said at least one of said electrical signals is only one electrical signal passed without being substantially attenuated.

6. The apparatus of claim 4, wherein said at least one switch comprises one of:

one switch configured to attenuate said at least one other of said electrical signals to substantially zero and to pass said at least one of said electrical signals without being substantially attenuated, and a corresponding plurality of switches, one for each of said coupled feeds, each configured to pass or attenuate one or more electrical signals propagating through said each of said coupled feeds.

7. The apparatus of claim 4, further comprising:

a corresponding plurality of band pass filters, at least one band pass filter for each of said coupled feeds, wherein said apparatus is configured to select said at least one band pass filter for each of said coupled feeds and wherein each of said band pass filters is configured to pass at least one further electrical signal of said at least one of said electrical signals by tuning said pass band, wherein said at least one further electrical signal is selected from said at least one of said electrical signals.

8. The apparatus of claim 7, wherein said at least one further electrical signal is only one electrical signal passed without being substantially attenuated.

9. The apparatus of claim 1, further comprising one of:

a corresponding transmission channel matched to one or more of said different frequencies, and a corresponding transmission channel implemented as a microwave transmission line and matched to one or more of said different frequencies, wherein each of said coupled feeds is coupled to the corresponding transmission channel.

10. The apparatus of claim 1, wherein a number of said coupled feeds is two.

11. The apparatus of claim 1, wherein a number of said coupled feeds is equal or smaller than a number of said different frequencies.

12. The apparatus of claim 1, wherein at least one of said electromagnetic signals has a first frequency, and a first corresponding coupled feed of said coupled feeds is configured to support one of:

a wireless local area network communication, a BLUETOOTH communication, and a WiMAX wireless metropolitan access network communication, and wherein at least one other of said electromagnetic signals has a second frequency, and a second corresponding coupled feed of said coupled feeds is configured to support one of a global positioning system communication, and a digital video broadcasting-handset communication.

13. The apparatus of claim 1, wherein said electromagnetic signals are radio signals.

14. The apparatus of claim 1, wherein said cover antenna forms a whole part of said partly or completely encapsulating metal cover of said apparatus.

15. The apparatus of claim 1, wherein said cover antenna is conductive throughout.

16. A method, comprising:

receiving or transmitting, by a cover antenna with a matching circuit and with a plurality of coupled feeds, a plurality of electromagnetic signals at different frequencies, each electromagnetic signal having a different frequency, wherein each of the coupled feeds is propagation optimized for at least one frequency selected from said different frequencies, wherein said cover antenna forms at least part of a partly or completely encapsulating metal cover of an electronic device, and wherein a distance between each of said plurality of coupled feeds and a grounding pin of said cover antenna is larger than a distance between said cover antenna and a printed wiring board within said electronic device and connected to said cover antenna via said grounding pin.

17. The method of claim 16, wherein each of said electromagnetic signals has a corresponding electrical signal of a corresponding further plurality of electrical signals, said corresponding electrical signal propagating only in one of said coupled feeds, said method further comprises:

switching said electrical signals so that at least one of said electrical signals is passed without being substantially attenuated and at least one another of said electrical signals is substantially attenuated with respect to the at least one of said electrical signals after it is passed.

18. The method of claim 17, wherein said at least one of said electrical signals is only one electrical signal passed without being substantially attenuated.

19. The method of claim 16, wherein each of said coupled feeds is coupled to one of:

a corresponding transmission channel matched to one or more of said different frequencies, and a corresponding transmission channel implemented as a microwave transmission line and matched to one or more of said different frequencies.

20. The method of claim 16, wherein a number of said coupled feeds is two.

21. The method of claim 16, wherein a number of said coupled feeds is equal or smaller than a number of said different frequencies.

22. The method of claim 16, wherein said electromagnetic signals are radio signals.

23. The method of claim 16, wherein said cover antenna forms a whole part of said partly or completely encapsulating metal cover of said electronic device.

24. A computer program product comprising: a non-transitory computer readable storage structure embodying computer program code thereon for execution by a computer processor with said computer program code, wherein said computer program code comprises instructions for performing the method of claim 16.

25. An apparatus, comprising:

means for receiving or transmitting, made of a conductive material, said means for receiving or transmitting forms at least a part of a partly or completely encapsulating metal cover of said apparatus; and a plurality of means for feeding from or to said means for receiving or transmitting, configured for reception or transmission of a plurality of electromagnetic signals at different frequencies, each electromagnetic signal having a unique frequency, wherein each of the means for feeding is optimized for at least one frequency selected from said different frequencies, wherein a distance between each of said plurality of coupled feeds and a grounding pin of said means for receiving or transmitting is larger than a distance between said means for receiving or transmitting and a printed wiring board within said apparatus and connected to said means for receiving or transmitting via said grounding pin.

26. The apparatus of claim 25, further comprising a matching circuit for said means for receiving or transmitting.

27. The apparatus of claim 26, wherein said matching circuit comprises the plurality of matching circuits and each coupled feed of the plurality of the coupled feeds comprises one corresponding circuit of the plurality of the matching circuits.

28. The apparatus of claim 25, wherein each of said electromagnetic signals has a corresponding electrical signal of a corresponding further plurality of electrical signals, said corresponding electrical signal propagating only in one of said coupled feeds, said apparatus further comprising:

at least one means for switching said electrical signals so that at least one of said electrical signals is passed without being substantially attenuated and at least one another of said electrical signals is substantially attenuated to zero.

29. The apparatus of claim 25, wherein said means for receiving and transmitting is a cover antenna.

* * * * *

UNITED STATES PATENT AND TRADEMARK OFFICE

CERTIFICATE OF CORRECTION

PATENT NO. : 7,936,307 B2
APPLICATION NO. : 11/492677
DATED : May 3, 2011
INVENTOR(S) : Hawk Yin Pang, Jani Ollikainen and Marko Leinonen It is certified that error appears in the above-identified patent and that said Letters Patent is hereby corrected as shown below:

In column, line 17 (claim 12, line 12) --:-- should be inserted after "of".

Signed and Sealed this
Nineteenth Day of July, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,936,307 B2
APPLICATION NO. : 11/492677
DATED : May 3, 2011
INVENTOR(S) : Hawk Yin Pang, Jani Ollikainen and Marko Leinonen It is certified that error appears in the above-identified patent and that said Letters Patent is hereby corrected as shown below:

Column 9, line 17 (claim 12, line 12) --:-- should be inserted after "of".

This certificate supersedes the Certificate of Correction issued July 19, 2011.

Signed and Sealed this
Sixteenth Day of August, 2011

David J. Kappos

David J. Kappos
*Director of the United States Patent and Trademark Office*